US005164570A

United States Patent [19]

Okimura

[11] Patent Number: 5,164,570

[45] Date of Patent: Nov. 17, 1992

[54] IMAGE RECORDING APPARATUS

[75] Inventor: Naomasa Okimura, Saitama, Japan

[73] Assignee: Fuji Xerox Co., Ltd., Tokyo, Japan

[21] Appl. No.: 674,938

[22] Filed: Mar. 26, 1991

[30] Foreign Application Priority Data

Apr. 6, 1990 [JP] Japan ..... 2-90436

[51] Int. Cl.[5] ..... G03G 15/20

[52] U.S. Cl. ..... 219/216; 355/290; 219/471

[58] Field of Search ..... 219/216, 469, 470, 471; 355/289, 290; 346/108, 160

[56] References Cited

U.S. PATENT DOCUMENTS

| | | | |
|---|---|---|---|
| 4,161,644 | 7/1979 | Yanagawa | 219/216 |
| 4,415,800 | 11/1983 | Dodge | 219/216 |
| 4,528,580 | 7/1985 | Inoue | 346/160 |
| 4,589,764 | 5/1986 | Tadokoro | 346/160 |
| 4,653,897 | 3/1987 | Fromm | 219/469 |

*Primary Examiner*—Teresa J. Walberg
*Attorney, Agent, or Firm*—Finnegan, Henderson, Farabow, Garrett and Dunner

[57] ABSTRACT

An image recording apparatus comprising a heat roll for fusing an toner image transferred onto a sheet by heating; a switching device for starting conduction of a heater installed within the heat roll; a temperature control device for controlling the surface temperature of the heat roll in a first predetermined temperature by controlling conduction of the heater when the switching device has been turned on and for controlling the surface temperature of the heat roll by increasing the surface temperature from a first temperature to a second predetermined temperature being different from the first temperature in response to a control signal; and a control device for applying the control signal to the temperature control device to approximately maintain the surface temperature of the heat roll in at least one of the first temperature and the second temperature.

11 Claims, 7 Drawing Sheets

IMAGE RECORDING APPARATUS

BACKGROUND OF THE INVENTION

The invention relates to image recording apparatuses for fusing toner images with a heat roll and, more particularly, to an image recording apparatus in which the surface temperature of the heat roll is controlled on two different levels, a sheet fusing level and a fusing standby level.

In electronic copying machines and image recording apparatuses, such as facsimile machines or laser printers using xerography, a latent electrostatic image formed on a photosensitive body is developed into a toner image by means of toner. This toner image is transferred onto a sheet or sheet member and fused thereafter. Among various techniques of fusing toner images, a technique based on a heat roll has been extensively used. The heat roll is so constructed that a heating body is contained inside the heat roll and the surface temperature of the heat roll is increased by conducting the heating body. The heat roll is used as a counterpart for a pressure roller which is in pressure contact with the heat roll. When the sheet passes between the heat roll and pressure roll, the toner is fused by the surface temperature of the heat roll and the fused toner is pressed onto the sheet surface to be fused and fixed.

In such conventional image recording apparatuses, an increase in the temperature of the heat roll to a toner image fusible temperature takes place abruptly and then such fusible temperature is maintained until the sheet arrives. However, such a technique has encountered the following problems.

(1) The relatively high fusible temperature of the heat roll leads to an increase in heat radiation and a waste of power. The heat roll whose surface temperature is high is dangerous if touched by a hand when no printing is performed, which is a safety problem.

(2) Since the heat roll is heated to a constant temperature for a long period of time, such constant temperature must be such that other parts of the image recording apparatus are not affected thereby. This has been a constraint in setting the fusing temperature to a temperature slightly lower than the ideal temperature required for continuous fusing. In other words, there is a risk in the conventional image recording apparatuses that incomplete fusing may result under certain conditions.

To overcome these problems, image recording apparatuses which can control the surface temperature of their heat roll on two levels have been marketed.

FIGS. 7(*a*) to 7(*c*) show an exemplary temperature control of a laser printer using a polygonal mirror, which is an exemplary image recording apparatus of such type. In FIG. 7(*a*) shows the timing of driving a motor for rotating the polygonal mirror (hereinafter referred to as "ROS motor"). Upon arrival of a print command from a host computer to the laser printer at a timing $T_1$, the ROS motor starts rotating. When the speed of the ROS motor reaches a desired constant speed after an interval $t_1$ has elapsed, a main motor of the laser printer starts rotating at a timing $T_2$ as shown in FIG. 7(*b*). This main motor serves to rotate not only the photosensitive body of the image recording apparatus but also its heat roll to get ready for fusing a sheet.

FIG. 7(*c*) shows an exemplary temperature control of the heat roll. The heat roll starts conduction at a timing at which a power supply of the image recording apparatus has been turned on and maintains a first set temperature S , which is higher than room temperature, once it has reached such temperature. As from the timing $T_2$ at which the main motor has been activated, the heat roll is controlled so that its temperature is increased to a second set temperature $S_2$ which is higher than the first set temperature $S_1$.

Now, after the activation of the main motor, a latent electrostatic image is formed on the photosensitive body and developed into a toner image by toner, and the toner image is transferred onto a sheet. Thus, it is important that the heat roll has its surface temperature increased to the second set temperature $S_1$, which is a predetermined fusing temperature, within an interval $t_2$ from the timing $T_2$ to the arrival of the front end of the sheet which interval is a finite period. An interval $t_3$ from such arrival timing $T_3$ is a period during which the sheet is being fused while passing through the heat roll. After an interval $t_4$ from a timing $T_4$ at which the fusing has been completed by the heat roll, the sheet is discharged; the main motor stops its operation; and the surface temperature of the heat roll starts decreasing to the first set temperature $S_1$. Thereafter, the ROS motor is turned off when an interval $t_5$ has elapsed. The rotation of the ROS motor is not stopped immediately because the ROS motor must check whether or not a next print command is being received.

FIG. 8 shows the above-described control more specifically. This image recording apparatus has a CPU (central processing unit) and the actual control is effected in accordance with a program stored in a storage medium such, as a ROM (read only memory), in such a manner as shown in FIG. 8.

Specifically, upon turning on of a main switch of the image recording apparatus, the CPU starts conduction of the heater contained within the heat roll so that the heater is subjected to a warmup for the first set temperature $S_1$ (Step (1) in FIG. 8). On the side of the heat roll is a temperature detecting element, with which the CPU checks whether or not the detected temperature is equal to the first set temperature $S_1$ (Step (2)). When the surface temperature of the heat roll reaches the first set temperature $S_1$ (Y), at which the image recording apparatus gets ready to fuse, the CPU lights up a ready lamp on an operation panel (Step (3)).

The image recording apparatus enters a standby state under this condition and monitors a timing at which a print command arrives from the host computer (Step (4)). Upon arrival of the print command (Y), the CPU controls an ROS motor drive circuit to start driving the ROS motor (Step (5)). When the ROS motor has reached a predetermined speed (Step (6), Y) thereafter, i.e., when the interval $t_1$ shown in FIG. 7 has elapsed, the driving of the main motor is started (Step (7)). Successively, the surface temperature of the heat roll is controlled so as to reach the second set temperature $S_2$ which is a fusible temperature (Step (8)). Such control is continued until a series of print operations have been completed by fusing a sheet and discharging the sheet to a discharge tray (Step (9)).

Upon completion of the print operations (Step (9), Y), the driving of the main motor is stopped (Step (10)), and the surface temperature of the heat roll is reset to the first set temperature $S_1$ (Step (11)). Thereafter, arrival of a next print command is monitored within the interval $t_5$ (Steps (12), (13)). Upon arrival of the print command (Step (12), Y), the CPU returns to Step (7) to start driving the main motor. If no print command has arrived (Step (13), Y), the CPU stops driving the ROS motor (Step (14)). If, on the other hand, the print command has arrived at this stage (Step (15), Y), the CPU returns to step (5) and starts driving the ROS motor.

As described above, in the conventional image recording apparatus, the timing of changing the set temperature of the heat roll from the first set temperature $S_1$ to the second set temperature $S_2$ for fusing coincides with the main motor driving start timing (FIG. 7). Therefore, upon the start of driving of the main motor, the heat roll is forced to begin heating up drastically to increase its surface temperature toward the second set temperature $S_2$.

In the meantime, when the main motor has started rotating, not only formation of a latent electrostatic image on the photosensitive body is started, but also a sheet is fed from a sheet feed tray and arrives near the photosensitive body to cause a toner image to be transferred onto the sheet. After the transfer, this sheet is forwarded to the heat roll. The interval of time elapsed from the photosensitive body or heat roll drive start to the arrival of the front end of the sheet at the heat roll is the interval $t_2$ shown in FIG. 7.

However, the interval $t_2$ has, in effect, been reduced by the ever-increasing print or recording speed of image recording apparatuses, such as laser printers, achieved by recent technical improvements, together with a trend toward compact design. Such reduction in the interval $t_2$ has caused, in some cases, a problem of inadequately fusing the toner image in a couple of starting pages introduced into the heat roll, although it depends on the heat roll material and the type of sheet to be fused.

FIG. 9 is a diagram for a description of such a case. In FIG. 9, the surface temperature of the heat roll is set to the first set temperature S up to the timing $T_2$ and, from this timing $T_2$ at which the main motor starts driving, the surface temperature is increased to the second set temperature $S_2$. However, in the case shown in FIG. 9, the heat roll has not reached the second set temperature $S_2$ until the fourth sheet has arrived. As a result, the fusing of the first to third sheets, among others, is incomplete.

The image recording apparatuses, such as laser printers, are usually used to print or record only one sheet or several sheets at a time. Thus, defective fusing of a first print or copy or in a couple of first prints or copies may often invite defects of many other following prints or copies, which is a serious problem.

SUMMARY OF THE INVENTION

An object of the invention is to provide an image recording apparatus capable of fusing images properly by controlling the surface temperature of the heat roll at two difference levels, a sheet fusing level and a sheet fusing standby level, so that incomplete fusing can be obviated even when sheet forward speeds are increased.

A first aspect of the invention is directed to an image recording apparatus comprising: a heat roll for fusing a toner image transferred onto a sheet by heating; a switch for starting conduction of a heater installed within the heat roll; fusing standby temperature control means for controlling a temperature so that a surface temperature of the heat roll can be set to a first set temperature, which is higher than room temperature, by controlling conduction of the heater when the switch has been turned on; and fusing temperature control means for starting heat control of the heater so that, upon reception of a recording data transfer ready signal from an external source, the surface temperature of the heat roll can be increased from the first set temperature to a second set temperature which is different from the first set temperature.

That is, the first aspect of the invention achieves the above object by causing the surface temperature of the heat roll to start increasing to the second set temperature $S_2$ at the time the recording data transfer ready signal has been received from the external source. Thus, the temperature of the heat roll starts increasing from a timing prior to the rotation of the main motor or the heat roll.

A second aspect of the invention is directed to an image recording apparatus comprising: a photosensitive body; a rotating polygonal mirror for scanning a laser beam on the photosensitive body; a motor for rotating the rotating polygonal mirror; means for transferring a toner image formed on the photosensitive body onto a sheet; a heat roll for fusing the toner image transferred by the transfer means onto the sheet by heating; a switch for starting conduction of a heater installed within the heat roll; fusing standby temperature control means for controlling a temperature so that a surface temperature of the heat roll can be set to a first set temperature, which is higher than room temperature, by controlling conduction of the heater when the switch has been turned on; and fusing temperature control means for starting heat control of the heater so that, upon start of rotating the motor for rotating the rotating polygonal mirror, the surface temperature of the heat roll can be increased from the first set temperature to a second set temperature which is different from the first set temperature.

That is, the second aspect of the invention, which is applied to an image recording apparatus using a polygonal mirror, achieves the above object by causing the surface temperature of the heat roll to be increased to the second set temperature $S_2$ at the timing the polygonal mirror has started rotating, considering the fact that the rotation of the polygonal mirror precedes that of the main motor or the heat roll.

A third aspect of the invention is directed to an image recording apparatus comprising: a photosensitive body; a rotating polygonal mirror for scanning a laser beam on the photosensitive body; a motor for rotating the rotating polygonal mirror; means for transferring a toner image formed on the photosensitive body onto a sheet; a heat roll for fusing the toner image transferred by the transfer means onto the sheet by heating; means for driving the heat roll while the sheet is being fused; a switch for starting conduction of a heater installed within the heat roll; fusing standby temperature control means for controlling a temperature so that a surface temperature of the heat roll can be set to a first set temperature, which is higher than room temperature, by controlling conduction of the heater when the switch has been turned on; timer means for measuring a predetermined interval of time from an instant of time at which the motor started rotating to an instant of time at which the heat roll starts rotating; and fusing temperature control means for starting heat control of the heater so that, upon measurement of the predetermined interval of time by the timer means, the surface temperature of the heat roll can be increased from the first set temperature to a second set temperature which is different from the first set temperature.

That is, the third aspect of the invention, which is applied to an image recording apparatus using a polygonal mirror, achieves the above object by causing the surface temperature of the heat roll to be increased to the second set temperature $S_2$ during an interval of time between the timing the polygonal mirror has started rotating and the timing the heat roll starts rotating, considering the fact that the rotation of the polygonal mirror precedes that of the main motor or the heat roll.

BRIEF DESCRIPTION OF THE DRAWINGS

FIGS. 1 to 5 are diagrams for a description of an embodiment of the invention, of which FIG. 1 is a block diagram showing a general circuit configuration of a laser printer;

FIG. 2 is a schematic showing the configuration of the laser printer;

FIG. 3(*a*) to 3(*c*) are timing charts showing an exemplary fusing temperature control of the laser printer;

FIG. 4 is a diagram showing a variation in the surface temperature of ah eat roll from a print command arrival to print starts for first several copies;

FIG. 5 is a flow chart showing a temperature control of the laser printer;

DETAILED DESCRIPTION OF THE PREFERRED EMBODIMENTS

Embodiments of the invention will now be described in detail.

Outline of Laser Printer Configuration

Figure 2:
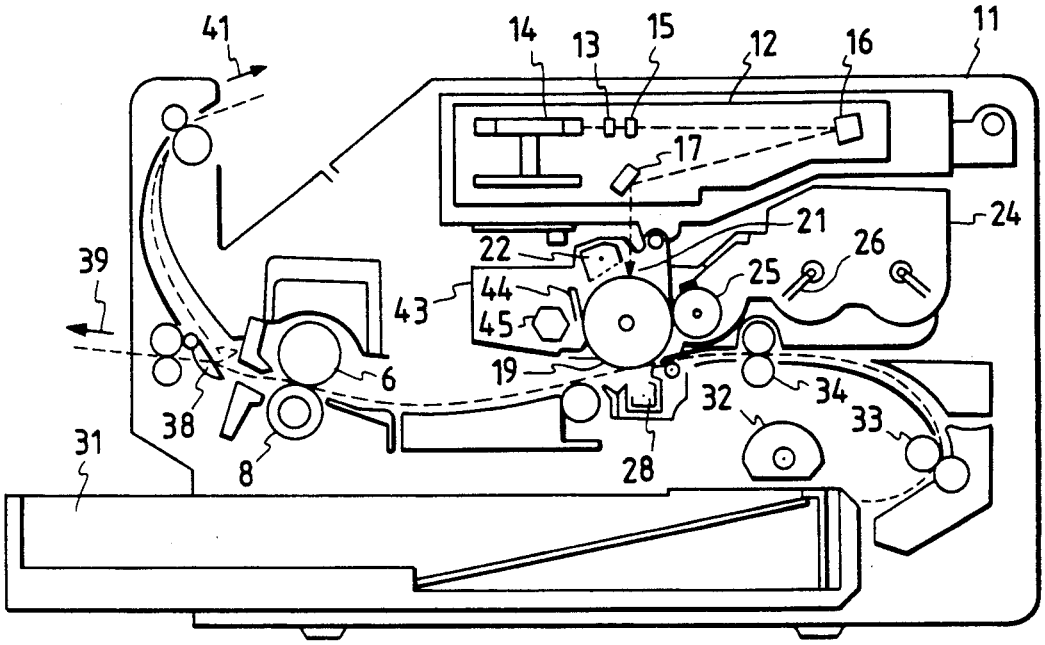

FIG. 2 shows the general configuration of a laser printer of the present invention, which is an embodiment of an image recording apparatus.

Laser printer 11 includes laser scanning unit 12. Laser scanning unit 12 includes semiconductor laser 13 which outputs a laser beam while modulating it in accordance with an image signal. A laser beam projected from semiconductor laser 13 is injected into polygonal mirror 14 and deflected in accordance with the rotation of polygonal mirror 14. The deflected laser beam, after having passed through f $\theta$ lens 15, is diverted by mirrors 16, 17, and outputted from laser scanning unit 12.

Below laser scanning unit 12 is photosensitive drum 19 which rotates at a constant speed. The laser beam outputted from laser scanning unit 12 scans predetermined exposure position 21 on photosensitive drum 19 in an axial direction of photosensitive drum 19, i.e., in a main scanning direction, repetitively. Slightly before exposure position 21 is charge corotron 22 confronting photosensitive drum 19 so that the surface of photosensitive drum 19 can be uniformly charged. As the laser beam is projected to charged photosensitive drum 19, a latent electrostatic image is formed on the drum surface in correspondence with the image data. The latent electrostatic image is developed on a drum surface which is located downstream of exposure position 21 by developer 24. Within developer 24 are components such as developing roll 25 for developing the latent electrostatic image by causing toner particles to "rise up" electrostatically and toner supply mechanism 26 for supplying the toner within a cartridge to developing roll 25. A predetermined developing bias is applied to developer 24.

A toner image formed through a development process performed by developer 24 is moved to a position confronting transfer corotron 28 by the rotation of photosensitive drum 19 and electrostatically transferred onto a recording sheet (normal paper) at this position. Charge corotron 22 and transfer corotron 28 used in this embodiment are of such construction that a single corotron wire is stretched between a ground and a voltage application terminal.

A sheet forward path will be described briefly. Recording sheets (not illustrated) are stacked on cassette tray 31 which is removably disposed below laser printer 11. A recording sheet arranged uppermost of cassette tray 31 is fed into the outside of tray 31 by a roll 32 having a notch in an axis direction as shown in FIG. 2. Other means such as a retard roll may be used in place of the roll 32.

The forwarded recording sheet advances a path shown by the broken line by forward rolls 33 and has its advance temporarily stopped upon arrival at the front ends of resist rolls 34. Then, a electromagnetic clutch (not illustrated) starts rotating resist rolls 34 in synchronism with photosensitive drum 19 in terms of position, and the forwarding of the recording sheet is initiated stably at a constant speed. Accordingly, the recording sheet passes through photosensitive drum 19 and transfer corotron 28 at desired timings. Transfer corotron 28 discharges only during such passing interval of time, thereby electrostatically attracting a toner image on photosensitive drum 19 toward transfer corotron 28 and transferring the toner image onto the recording sheet. The transferred recording sheet has the charges removed by a charge removing needle (not illustrated) arranged downstream of transfer corotron 28, causing the recording sheet to be separated from the drum surface.

The separated recording sheet, after having been forwarded along a forward path of a predetermined length to relax its tension, is carried to a fusing unit including a pair consisting of heat roll 6 and pressure roll 8. The recording sheet passes through between heat roll 6 and pressure roll 8, both forming a nip at a predetermined width, at the fusing unit. At this time, with the toner image transferred side of the recording sheet facing heat roll 6, pressure roll 8 presses the recording sheet onto heat roll 6 to allow efficient heat conduction. As described before, heat roll 6 is subjected to such a temperature control that its surface temperature is set to the second set temperature $S_2$, which is a higher temperature, at the time the recording sheet has arrived thereat and that the surface temperature is set to the first set temperature $S_1$, which is a lower temperature, at any timing other than that. The toner image on the recording sheet thermally fused while the second set temperature $S_2$ is being maintained.

On the discharge side of the fusing unit is selector 38 for selecting a forward path after the recording sheet has been fused. Selector valve 38 diverts the fused recording sheet into either first discharge direction 39 by sending the recording sheet straight out or second discharge direction 41 which is in a direction substantially opposite to first discharge direction 39 and causes the recording sheet to follow a "C"-formed path within the unit to be discharged from the upper portion of laser printer 11. The availability of two paths is to allow the recording sheet to be selectively discharged faceup or facedown. Discharging of the recording sheets facedown by selecting second discharge direction 41 allows recording sheets to be discharged in the same order as they have been printed, thereby enabling them to be stapled as discharged.

The toner image not transferred onto the recording sheet is removed from the drum surface by cleaning unit 43 disposed further downstream of transfer corotron 28. Cleaning unit 43 includes blade 44 for scraping the toner from the drum surface and rotary body 45 for evacuating toner particles deposited below blade 44 to a container located at a position in the back.

Outline of Circuit Configuration

Figure 1:
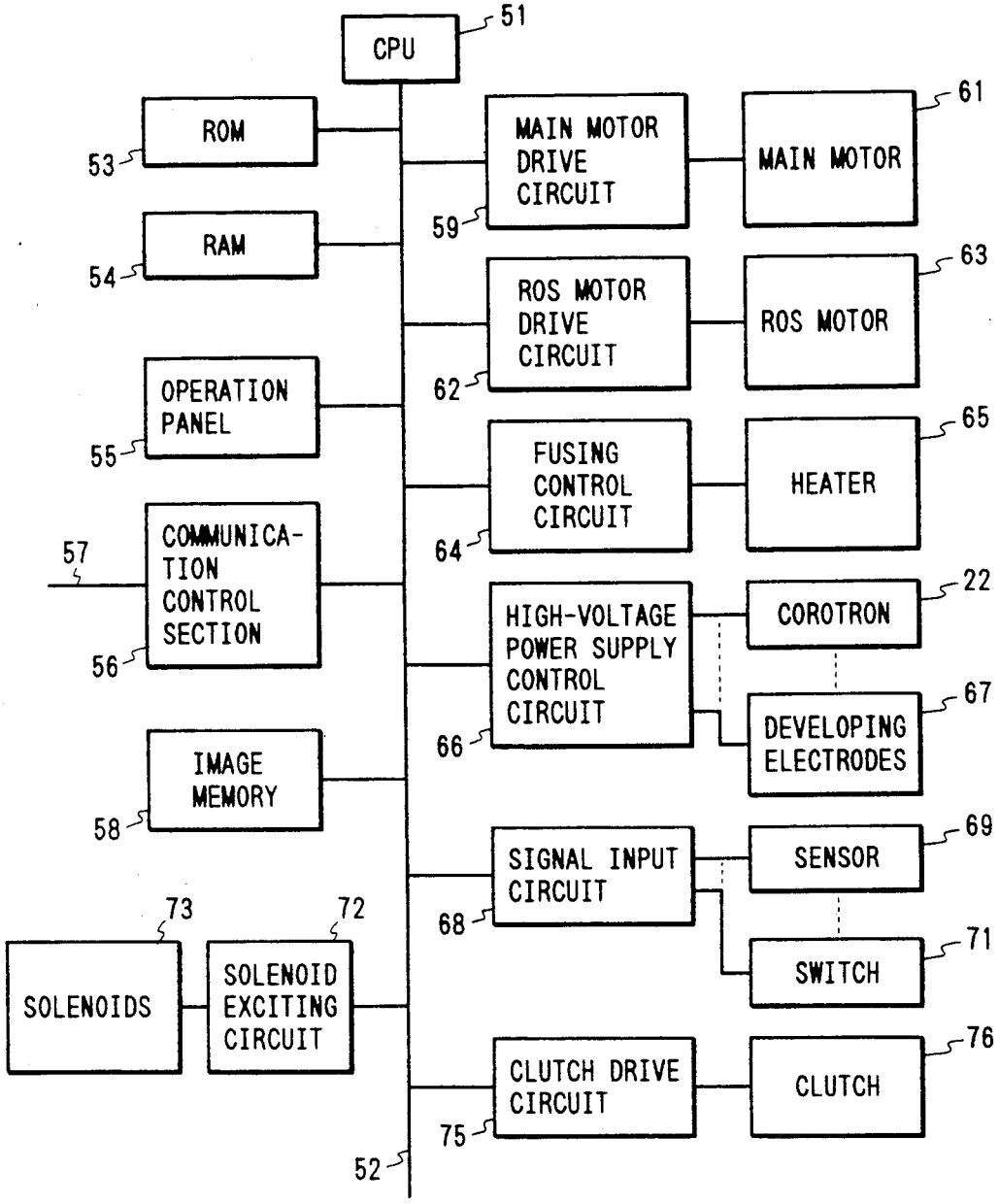

FIG. 1 shows a general configuration of a circuit portion of the thus constructed laser printer. Laser printer 11 includes CPU 51. CPU 51 is connected to the following components through bus 52, such as a data bus, so that not only the surface temperature of heat roll 6 can be controlled but a general control of laser printer 11 can be performed as well.

(1) ROM 53: A read only memory which stores a program for performing various controls of laser printer 11.

(2) RAM 54: A random access memory which temporarily stores various data.

(3) Operation panel 55: A panel for performing various operations and displays thereon.

(4) Communication control section 56: A unit, connected to a host computer (not illustrated) through cable 57, for receiving print data and intercommunicating control data.

(5) Image memory 58: A memory which stores print data.

(6) Main motor drive circuit 59: A circuit for driving main motor 61 which drives various rollers such as photosensitive drum 19, heat roll 6, and recording sheet forward rollers of laser printer 11.

(7) ROS motor drive circuit 62: A circuit for driving ROS motor 63 which drives polygonal mirror 14.

(8) Fusing control circuit 64: A circuit for controlling conduction of heater 65 which is installed within heat roll 6.

(9) High-voltage power supply control circuit 66: A circuit for generating high-voltage power supplies and applying them to such corotrons as charge corotron 22 and developing electrodes 67.

(10) Signal input circuit 68: A circuit for processing signals fed from various signal generating sources such as temperature sensor 69 for measuring the surface temperature of heat roll 6 and photosensitive switch 71 disposed on recording sheet forward paths and sending the processed signals to bus 52.

(11) Solenoid exciting circuit 72: A circuit for controlling excitation of solenoids which control the selection of selector switch 38 (FIG. 2).

(12) Clutch drive circuit 75: A circuit for controlling the drive of clutch 76 which controls the rotation of rollers on the forward paths.

Control of Fusing Temperature

Figure 3:
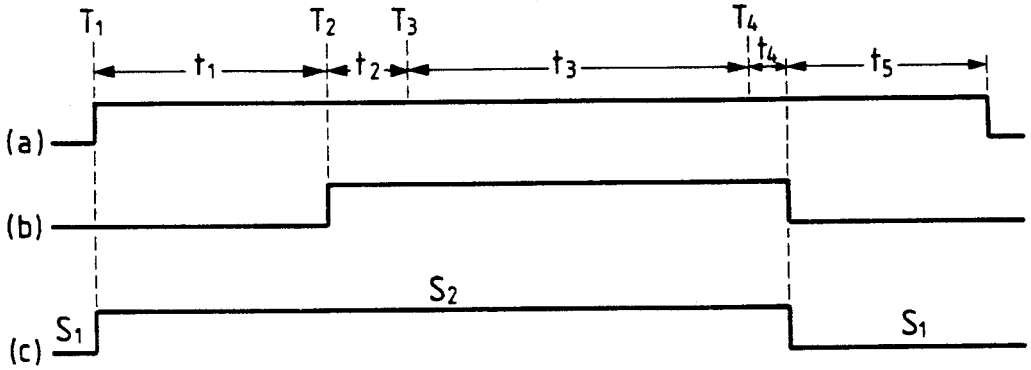
Figure 7:
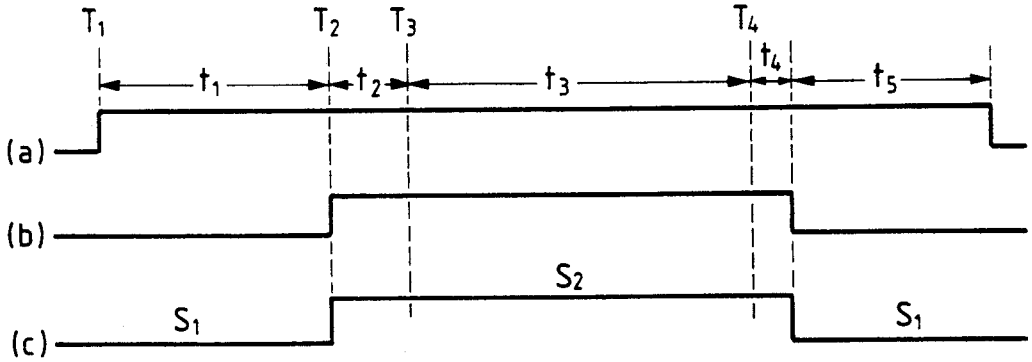
FIGS. 7(*a*) to 7(*c*) are timing charts showing a fusing temperature control of a conventional image recording apparatus.

FIGS. 3(*a*) to 3(*c*) show fusing temperature control timings of laser printer 11, which is the embodiment of the present invention. FIGS. 3(*a*) to 3(*c*) corresponds to FIGS. 7(*a*) to 7(*c*). FIG. 3(*a*) shows the timing of driving ROS motor 63. Upon arrival of a print command from the host computer to laser printer 11 at timing $T_1$, ROS motor 63 starts rotating. When the speed of ROS motor 63 reaches a desired level after an interval $t_1$ has elapsed, main motor 61 of laser printer 11 starts rotating at timing $T_2$ as shown in FIG. 3(*b*). This main motor 61 serves to rotate not only photosensitive body 19 but also cause heat roll 6 to get ready for fusing a sheet. These controls shown in FIGS. 3(*a*) and 3(*b*) do not differ from the conventional controls shown in FIGS. 7(*a*) and 7(*b*).

FIG. 3(*c*) shows an exemplary temperature control of heat roll 6. Heat roll 6 starts conduction from a timing at which a power supply of laser printer 11 has been turned on and is maintained at first set temperature $S_1$, which is higher than room temperature, once it has reached such temperature. As from timing $T_1$ at which the print command has arrived from the host computer, heat roll 6 is controlled to have its temperature increased to second set temperature $S_2$ which is higher than first set temperature $S_1$. When the surface temperature of heat roll 6 has reached second set temperature $S_2$, such temperature is maintained. And after interval $t_4$ from timing $T_4$, the sheet is discharged; main motor 61 stops its operation; and the surface temperature of heat roll 6 starts decreasing to first set temperature $S_1$.

Accordingly, laser printer 11, in this preferred embodiment, subjects heat roll 6 to temperature increase control to second set temperature $S_2$ from timing $T_1$, a timing prior to timing $T_2$ at which heat roll 6 starts rotating. Therefore, even when the front end of the recording sheet arrives at heat roll 6 at and after the timing at which heat roll 6 has started rotating and interval $t_2$ has elapsed thereafter, it is easy to have the surface temperature of heat roll 6 reach second set temperature $S_2$.

Figure 4:
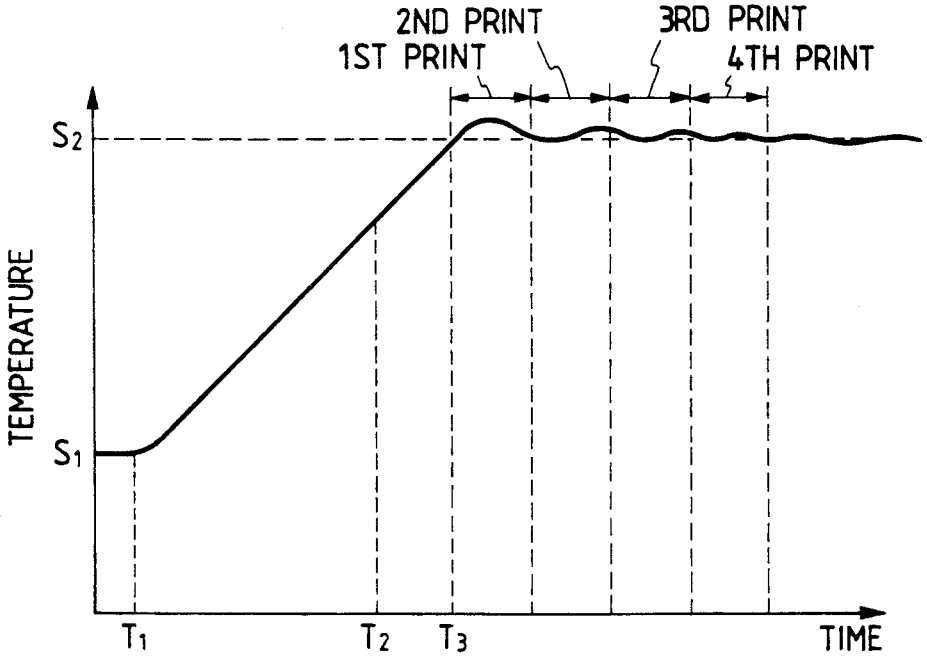
Figure 9:
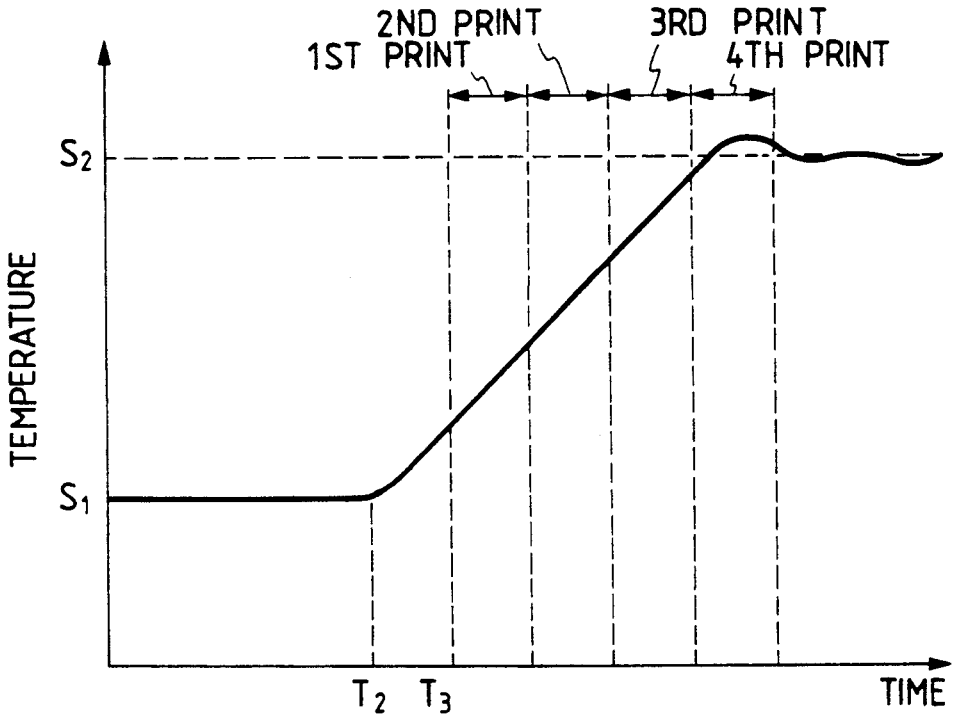
FIG. 9 is a diagram showing a variation in the surface temperature of a heat roll.

FIG. 4, which corresponds to FIG. 9, shows a variation in the surface temperature of heat roll 6 between a print command arrival and an interval of time during which a couple of first prints have been made. In laser printer 11 the surface temperature of heat roll 6 is set to first set temperature $S_1$ as in the conventional apparatus shown in FIG. 9. A print command is received by laser printer 11 from the host computer at timing $T_1$. Successively, the print data is received. Upon reception of the print command, CPU 51 not only causes ROS motor 63 to start rotating but also changes the surface temperature of heat roll 6 to second set temperature $S_2$. Accordingly, the surface temperature of heat roll 6 increases linearly. At timing $T_2$ in the course of such increase, main motor 61 starts driving, causing heat roll 6 to start rotating. And a sheet fusing operation starts at timing $T_3$. As is clear from a comparison of FIG. 4 with FIG. 9, the change in the set temperature of heat roll 6 in this embodiment takes place at timing $T_1$ which is far earlier than timing $T_3$, and this allows proper fusing to be performed from the very first recording sheet at second set temperature $S_2$.

Figure 5:
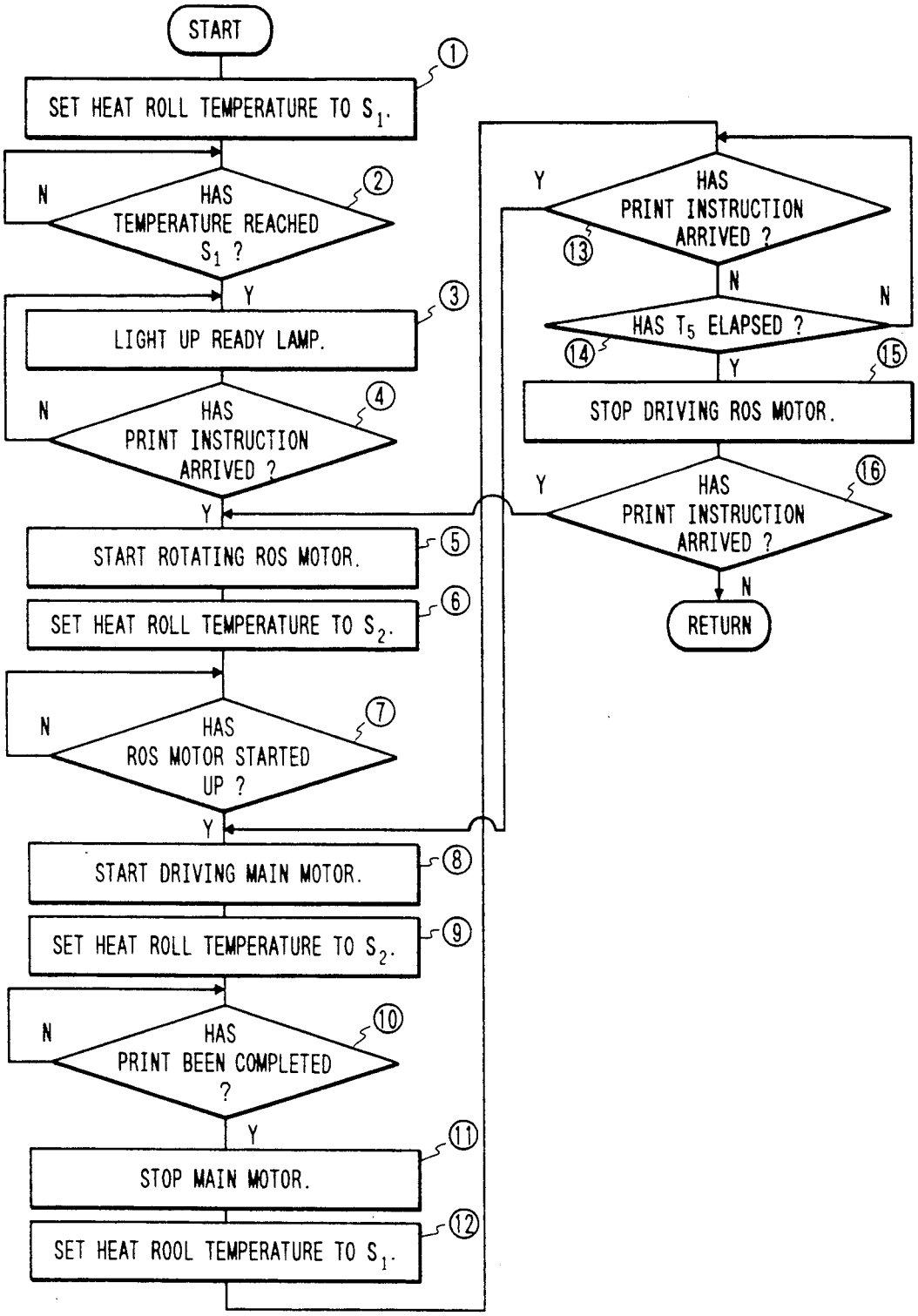
Figure 8:
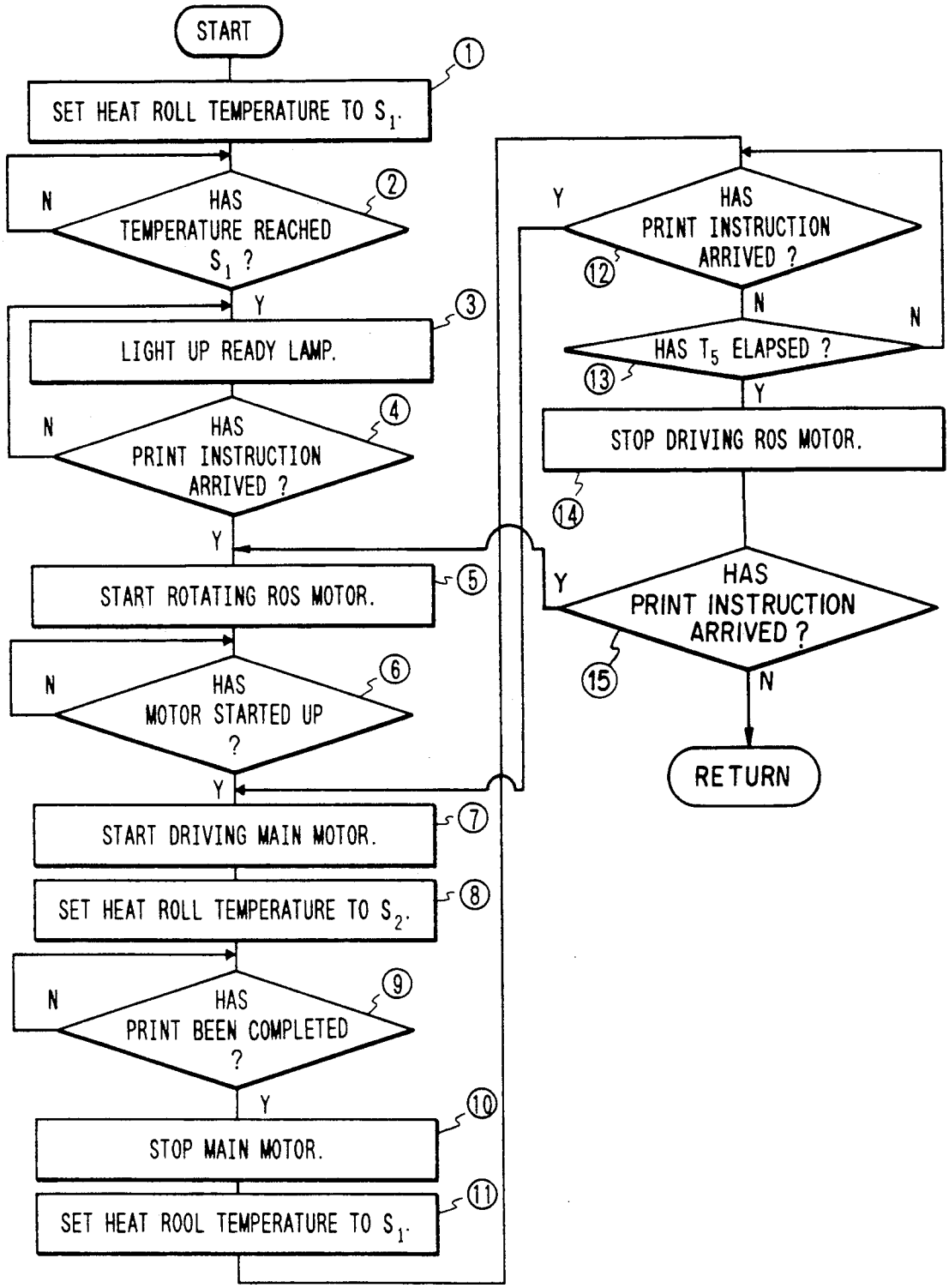
FIG. 8 is a flow chart showing a temperature control of the conventional image recording apparatus.

FIG. 5 corresponds to FIG. 8 and shows the above-described temperature control of the preferred embodiment laser printer 11 more specifically. Temperature control of laser printer 11 will be described with reference to FIG. 1.

When an operator has turned on a main switch (power switch) of laser printer 11, CPU 51 initiates heating control by controlling fusing control circuit 64 so that the surface temperature of heat roll 6 is set to first set temperature $S_1$ (Step (1) in FIG. 5). CPU 51 monitors temperatures detected by temperature sensor 69, and when a detected temperature is equal to first set temperature $S_1$ (Step (2), Y), CPU 51 lights up a ready lamp on operation panel 55 (Step (3)).

Laser printer 11 enters a standby state under this condition and monitors a timing at which a print command arrives from the host computer through communication control section 56 (Step (4)). Upon arrival of the print command (Y), CPU 51 controls ROS motor drive circuit 62 to start driving ROS motor 63 (Step (5)). Simultaneously therewith, CPU 51 controls fusing control circuit 64 to change the surface temperature of heat roll 6 to second set temperature $S_2$ (Step (6)). Accordingly, the surface temperature of heat roll 6 rises to second set temperature $S_2$.

Thereafter, when ROS motor 63 has reached a predetermined speed (Step (7), Y), i.e., interval $t_1$ shown in FIG. 3 has elapsed, the driving of main motor 61 is initiated (Step (8)). Here again, the surface temperature of heat roll 6 is set to second set temperature $S_2$ (Step (9)). Thereafter, this temperature control is continued until a series of print operations have been completed by printing and fusing the recording sheet and discharging the recording sheet into a not shown discharge tray (Step (10)).

Upon completion of the print operations (Step (10), Y), the driving of main motor 61 is stopped (Step (11)), and the surface temperature of heat roll 6 is reset to first set temperature $S_1$ (Step (12)). Thereafter, arrival of a next print command is monitored within interval $t_5$ (Steps (13), (14)). Upon arrival of the print command (Step (13), Y), CPU 51 returns to Step (8) to start driving main motor 61 and set the surface temperature to second set temperature $S_2$ again (Step (9)).

If no next print command has arrived within interval $t_5$ (Step (14), Y), CPU 51 stops driving ROS motor 63 (Step (15)). If, on the other hand, the print command has arrived at this stage (Step (16), Y), CPU 51 returns to Step (5) to start driving ROS motor 63.

In this embodiment, when the driving of main motor 61 stops in Step (11), the surface temperature of heat roll 6 is reset to first set temperature $S_1$ (Step (12)), so when the print command has arrived in Step (13), CPU 51 returns to Step (8) to drive main motor 61, set the surface temperature to second set temperature $S_2$ (Step (9)), and perform printing and fusing. At this time, an interval of time before heat roll 6 rises to second set temperature $S_2$ becomes relatively short. The high temperature which heat roll 6 has once reached is not lowered so drastically that a next recording sheet can be fused at second set temperature $S_2$ as long as an interval which is as long as interval $t_2$ shown in FIG. 3 is provided.

Modified Exemplary Temperature Control

In the above embodiment, the timing of switching the set temperature of the heat roll of the laser printer, which is an example of an image recording apparatus, is selected to coincide with either the arrival of a print command from the host computer or the ROS motor rotation start timing. If it takes a comparatively long time for the ROS motor to reach a prescribed speed from its rotation start, the timing of switching the set temperature may be selected to coincide with a timing at which a predetermined interval of time between the ROS motor rotation start and the heat roll rotation start has elapsed.

Figure 6:
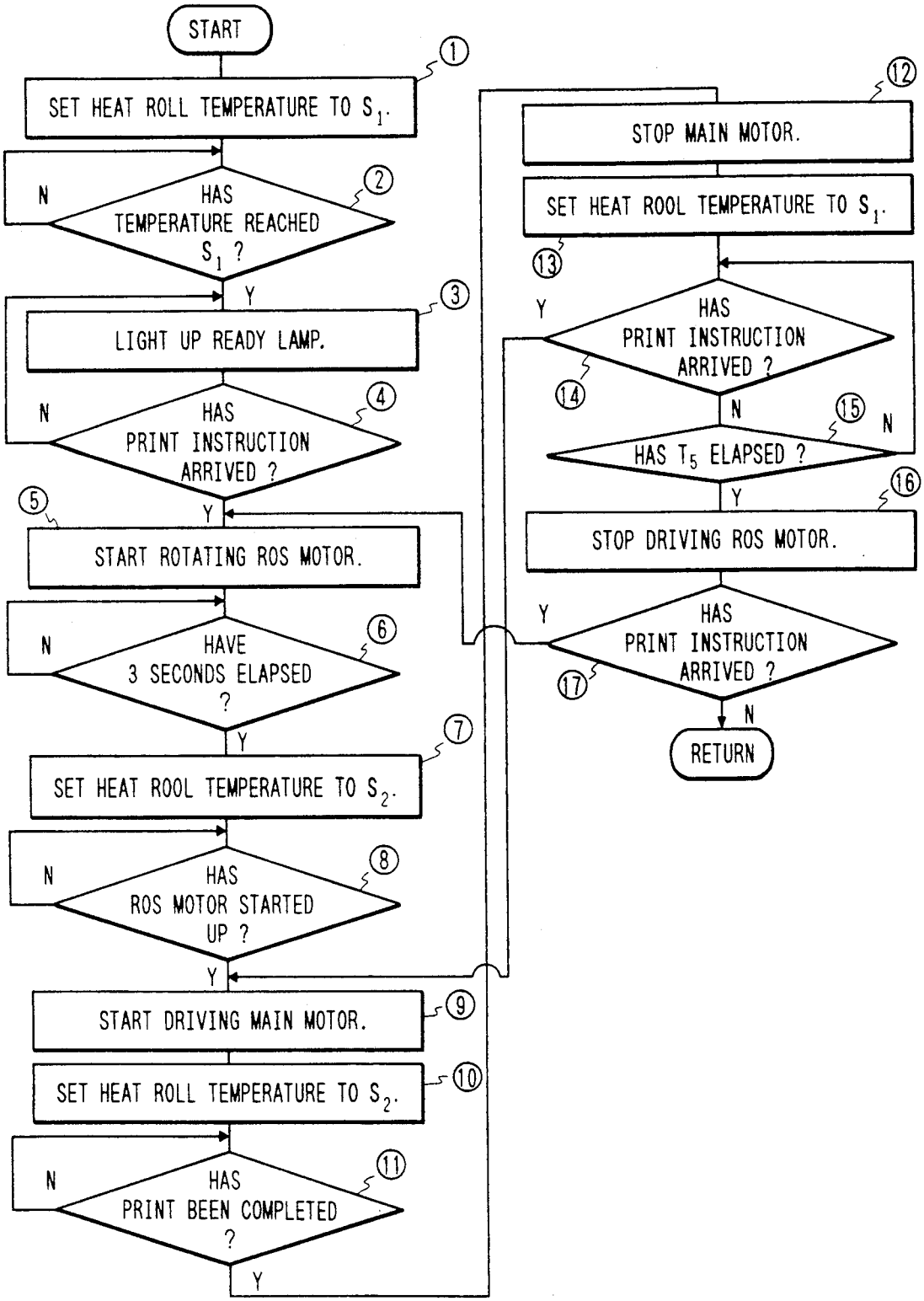
FIG. 6 is a flow chart showing a temperature control of the laser printer, which is a modified example of the invention.

FIG. 6 corresponds to FIG. 5 and shows a modified exemplary temperature control of the laser printer described in the previous embodiment.

In this modified exemplary temperature control, the operations from Step (1) to Step (5) are the same as those of the previous embodiment. In the modified example, upon start of driving ROS motor 63 in Step (5), CPU 51 starts measuring time intervals, and when 3 seconds have elapsed (Step (6), Y), it changes the surface temperature of heat roll 6 to second set temperature (Step (7)). The control operations thereafter are the same as those in the respective steps shown in FIG. 5 except that "1", is added to each parenthesized step number.

That is, in the modified example, the interval of time between the ROS motor 63 driving start and the main motor 61 drive start is longer than 3 seconds, and considering this fact, the switching of the surface temperature to second set temperature $S_2$ is so controlled as to take place 3 seconds after the ROS motor 63 drive start. The setting of a delay in switching the surface temperature may be determined as a function of various factors, such as ROS motor characteristics, relationships between first and second set temperatures $S_1$ and $S_2$, or temperature characteristics of the heat roll material.

While the image recording apparatus using the ROS motor has been described in both the embodiment and modified example, the invention may, of course, be applicable to various other image recording apparatuses using a heat roll for fusing. Further, while the switching of the set temperature from $S_1$ to $S_2$ is so controlled as to take place at the main motor or heat roll drive stop in both the embodiment and modified example, it may be so controlled as to take place upon detection by a sensor disposed at the recording sheet forward paths, or with, example, the ROS motor drive stop as a reference.

Thus, according to the first aspect of the invention, the heating control of the heater is started upon reception of a recording data transfer ready signal from the external source so that the surface temperature of the heat roll is increased from the first set temperature to the second set temperature which is different from the first set temperature. Therefore, a stable fusing operation is ensured from the very first recording sheet onto which a toner image has been transferred. In addition, the switching of the set point of the surface temperature of the heat roll takes place upon arrival of the signal from the host computer or the like, thereby providing the advantage that the temperature switching operation is simple.

According to the second aspect of the invention, the apparatus, which includes a rotating polygonal mirror for scanning a laser beam and a motor for rotating the rotating polygonal mirror, has the surface temperature of the heat roll increased from the first set temperature to the second set temperature which is higher than the first set temperature upon start of rotating the motor. Therefore, a stable fusing operation is similarly ensured from the very first recording sheet onto which a toner image has been transferred. In addition, the switching of the set point of the surface temperature of the heat roll takes place upon start of driving the motor for rotating the polygonal mirror, thereby providing the advantage that the temperature switching operation is simple.

According to the third aspect of the invention, the similar apparatus including a rotating polygonal mirror for scanning a laser beam and a motor for rotating the rotating polygonal mirror controls the operation of switching the set point of the surface temperature of the heat roll in such a manner that such control takes place with a delay lasting from the motor rotation start to a predetermined timing. Therefore, the temperature control can be performed economically even if it takes time to get the polygonal mirror to start up. In addition, the first set temperature can be set to a temperature lower than the conventional, thereby allowing the warmup period to be shortened.

What is claimed is:

1. An image recording apparatus comprising:

means for fusing a toner image transferred onto a sheet by heating, said means for fusing including heat roll means;

means for starting conduction of a heater installed within said heat roll means, said means for starting including switching means;

means for controlling a surface temperature of said heat roll means to a first predetermined temperature when said switching means has been turned on and for controlling said surface temperature of said heat roll means by increasing said surface temperature from the first predetermined temperature to a second predetermined temperature different from said first predetermined temperature in response to a control signal; and means for applying said control signal to said temperature control means upon receipt of a recording data transfer signal.

2. An image recording apparatus as claimed in claim 1, wherein said second predetermined temperature is higher than said first predetermined temperature.

3. An image recording apparatus as claimed in claim 1 wherein said first predetermined temperature is at least ambient temperature.

4. An image recording apparatus as claimed in claim 1, further comprising:

means for scanning a laser beam on a photosensitive body;

means for operating said scanning means, said means for operating including motor means; and means for transferring a toner image formed on said photosensitive body onto said sheet.

5. An image recording apparatus as claimed in claim 4, further comprising:

means for measuring a predetermined interval of time from said receipt of said recording data transfer signal, at the beginning of which interval said motor means starts operating, to a time at which said heat roll means starts rotating, said means for measuring including timer means.

6. An image recording apparatus as claimed in claim 4, wherein said control means generates said control signal at the start of operation of said motor means.

7. A method for operating an image recording apparatus comprising the steps of:

starting conduction of a heater installed within a heat roll, said heat roll fusing a tone image transferred onto a sheet by heating, by switching means which starts said conduction of said heater;

setting the surface temperature of said heat roll at a first predetermined temperature by a temperature control means which controls said surface temperature when said switching means has been turned on and which controls said surface temperature of said heat roll by changing said surface temperature from said first predetermined temperature to a second predetermined temperature different from said first predetermined temperature in response to a control signal; and applying said control signal to said temperature control means by a control means upon receipt of a recording data transfer signal to change said surface temperature of said heat roll from said first predetermined temperature to said second predetermined temperature.

8. A method according to claim 7, wherein said second predetermined temperature is higher than said first predetermined temperature.

9. A method according to claim 7, wherein said first predetermined temperature is at least ambient temperature.

10. An image recording apparatus comprising:

means for scanning a laser beam on a photosensitive body;

means for operating said scanning means, said means for operating including motor means;

means for transferring a toner image formed on said photosensitive body onto said sheet;

means for fusing said toner image onto said sheet by heating, said means for fusing including heat roll means;

means for starting conduction of a heater installed within said heat roll means, said means for starting including switching means;

means for controlling a surface temperature of said heat roll means at a first predetermined temperature by controlling conduction when said switching means has been turned on and for controlling said surface temperature of said heat roll means by increasing said surface temperature from the first predetermined temperature to a second predetermined temperature different from said first predetermined temperature in response to a control signal;

means for measuring a predetermined interval of time upon receipt of a recording data transfer signal, at the beginning of which interval said motor means starts operating, to a time at which said heat roll means starts rotating, said means for measuring including timer means; and means for applying said control signal to said temperature control means when said predetermined interval of time is measured by said timer means.

11. A method for operating an image recording apparatus having a motor for operating a means for scanning a laser beam on a photosensitive body, a timer means for measuring a predetermined interval of time from receipt of a recording transfer signal, at the beginning of which interval said motor starts to operate, and heat roll mans for fusing a tone image transferred onto a sheet by heating, comprising the steps of:

starting conduction of a heater, installed within said heat roll means, by use of switching means;

setting the surface temperature of said heat roll means at a first predetermined temperature by a temperature control means which controls said conduction of said heater when said switching means has been turned on and which controls said surface temperature by changing said surface temperature from said first predetermined temperature to a second predetermined temperature different from said first predetermined temperature in response to a control signal;

generating said control signal when said predetermined interval of time is measured by said timer means; and applying said control signal to said temperature control means by a control means upon receipt of said control signal.

* * * * *

UNITED STATES PATENT AND TRADEMARK OFFICE

CERTIFICATE OF CORRECTION

PATENT NO. : 5,164,570

DATED : November 17, 1992

INVENTOR(S) : Naomasa OKIMURA

It is certified that error appears in the above-identified patent and that said Letters Patent is hereby corrected as shown below:

Claim 11, Column 12, Line 58, change "mans" to --means--.

Signed and Sealed this

Twenty-first Day of December, 1993

*Attest:*

*Attesting Officer*

BRUCE LEHMAN

*Commissioner of Patents and Trademarks*